United States Patent [19]

Travaglio et al.

[11] 3,941,310

[45] Mar. 2, 1976

[54] THERMOSTATIC CONTROL FOR USE IN VARIABLE AIR DISTRIBUTION SYSTEMS

[75] Inventors: Dalny Travaglio, Kensington, Calif.; Konstantins Dravnieks, Madison; Gordon C. Sylvester, Verona, both of Wis.

[73] Assignee: Wehr Corporation, Milwaukee, Wis.

[22] Filed: Jan. 28, 1974

[21] Appl. No.: 437,136

[52] U.S. Cl. ..... 236/49; 236/80 R; 236/92 R

[51] Int. Cl.[2] ..... F24F 1/00

[58] Field of Search ..... 236/49, 80, 82, 89, 92 R, 236/87, 99 A; 98/1.5; 137/468

[56] References Cited

UNITED STATES PATENTS

| | | | |
|---|---|---|---|
| 1,979,779 | 11/1934 | Tobin | 236/92 R |
| 2,695,752 | 11/1954 | Rodeck | 236/49 |
| 3,122,318 | 2/1964 | Null | 236/80 |
| 3,275,238 | 9/1966 | Nilles | 236/87 |
| 3,465,962 | 9/1969 | Matulich et al. | 236/80 |
| 3,537,644 | 11/1970 | Davison | 236/80 |
| 3,602,241 | 8/1971 | Puster | 236/82 |
| 3,719,321 | 3/1973 | McNabney | 236/49 |
| 3,809,314 | 5/1974 | Engelke et al. | 236/49 |

*Primary Examiner*—William E. Wayner
*Assistant Examiner*—William E. Tapolcai, Jr.

[57] ABSTRACT

Air flow volume in a delivery duct is sensed in the form of changes in duct pressure and the sensed pressure is fed back to a diaphragm assembly which is part of a thermostatic control located in the room to which hot or cold air is being delivered. Dependent upon the sensed pressure, the diaphragm assembly throttles a bleed opening in the supply line of a pneumatic actuator, which actuator determines the position of a damper in the duct to thereby control the volume of air flow in the duct. A bellows is also part of the thermostatic control and senses room temperature to establish a spring force on the diaphragm assembly and against which the sensed pressure must act. The bellows is adjustable to afford room temperature selection. The bellows and a compression spring act on a master lever, the compression spring reacts against the bellows force. The combination bellows-spring produces movement of the master lever in two opposite directions and this movement is utilized to activate a control for continuously switching the system between delivery of cold or hot air. The thermostatic control includes a second lever moved in response to the bellows-spring movement. The position of the second lever establishes a biasing force against which, in the diaphragm assembly, the sensed duct pressure must act in establishing the position of the damper. A cam arrangement is associated with this second lever and is effective to determine the position, and movement, of the lever so as to provide selection in the percent of available air capacity which is utilized and/or lever movement between maximum and minimum limits as desired.

16 Claims, 13 Drawing Figures

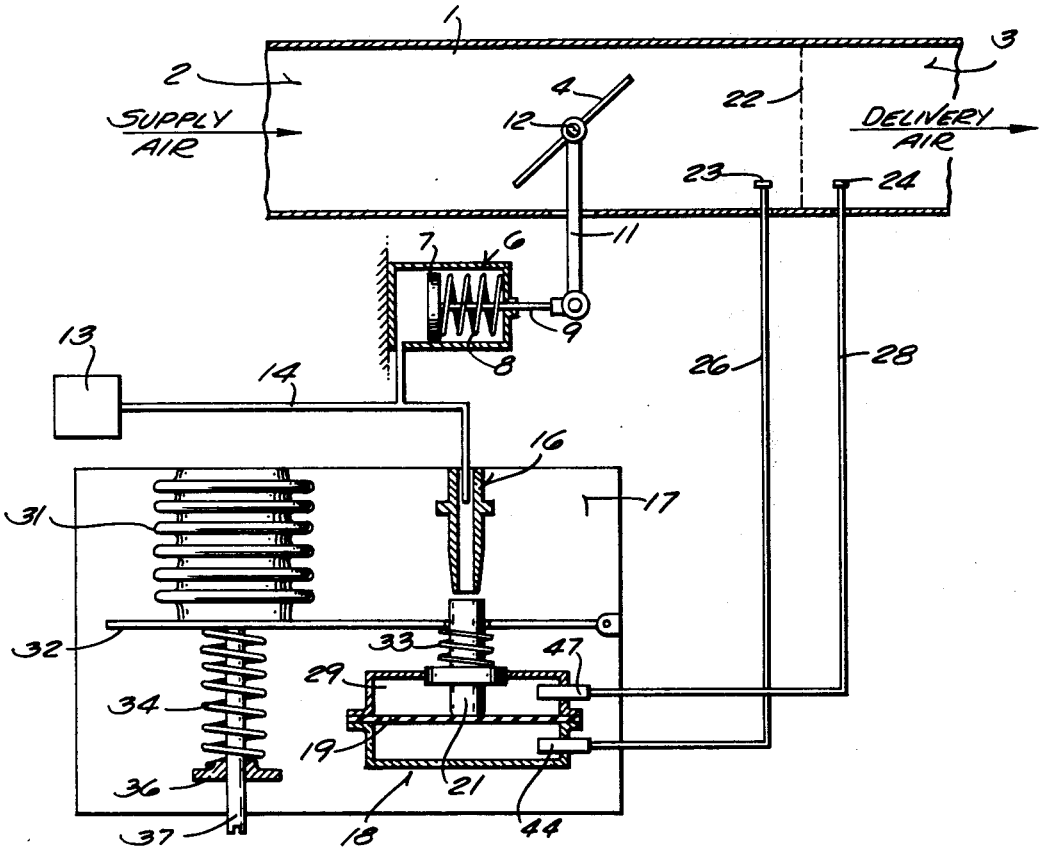

Fig. 6
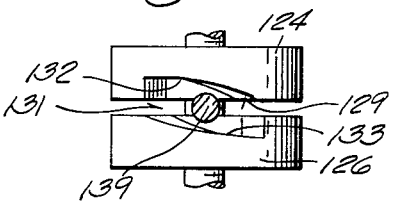
Fig. 7
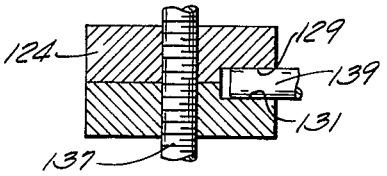
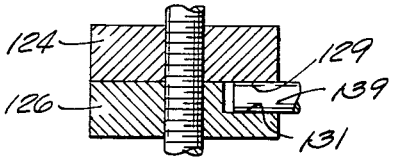
Fig. 8
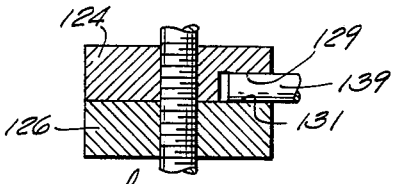
Fig. 9
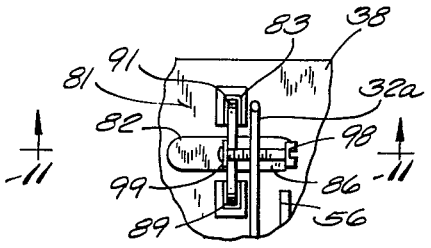
Fig. 10
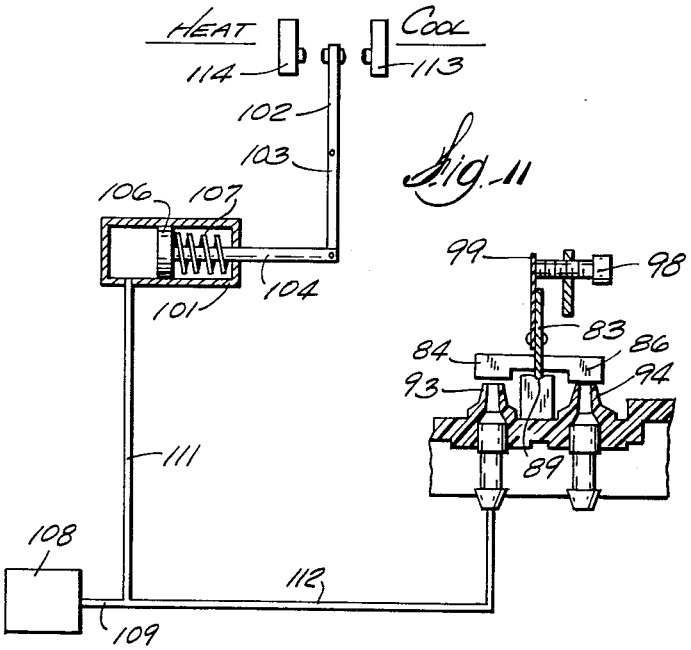
Fig. 11
Fig. 12
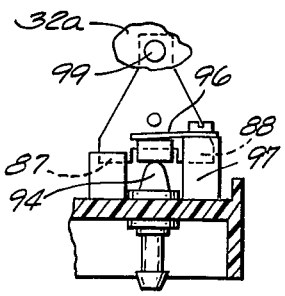

THERMOSTATIC CONTROL FOR USE IN VARIABLE AIR DISTRIBUTION SYSTEMS

BACKGROUND OF INVENTION

This invention relates to air distribution systems and, more particularly, to a thermostatic control usable in such systems.

Variable air volume distribution systems have gained acceptance in the air distribution field. Such systems are adapted tp provide different volumes of conditioned air to achieve particular temperatures in areas being serviced, thus the name variable air volume systems. Some systems go a step further and are adapted to provide a constant volume flow of air at that particular volume selected to achieve a given temperature condition. These are referred to in the air distribution field as constant variable volume systems. This invention is concerned with such systems.

Most often the interior spaces of a building are heated year-round by lighting and to a lesser degree, by people and heat loss from other electrical apparatus, and it is necessary to remove heat through the introduction of cold air. There are, of course, applications where the building interior will be furnished with hot air. The desirability of constant variable volume air delivery systems in such cooling, and/or heating, installations has been well recognized and the problem is to achieve overall control taking into account variations in the flow volume of delivery air to and variances in temperature in the room being serviced. This invention is concerned with that problem.

Conventional control thermostats usually provide either heating or cooling control, i.e. in an air system they regulate the volume of air being introduced into the room as a percentage of available air capacity starting from a base point. For example, a thermostat set at 74° F. may call for 50% more cooling air if the temperature rises to 75° F. and 100% more cooling air if the temperature rises to 76° F. In a heating application the same is true as the demand for hot air increases. Generally, in order to provide heating and cooling in the same system two thermostats have been required; calibration of the two thermostats is extremely difficult and in most instances overlap of the control function between the two thermostats cannot be avoided. In its more specific aspects, this invention is also concerned with this problem of providing continuous heating and cooling capability in a single control.

SUMMARY OF INVENTION

Among the general objects of this invention are to provide a variable volume flow of conditioned air to achieve a particular desired temperature in the area being serviced and to do so with a simple and effective control mechanism which also maintains a constant volume flow of air at the desired temperature.

Another object of this invention is to provide a single thermostat unit with the capability of providing continuous heating and cooling operation of an air delivery system.

Another more specific object of this invention is to make provision in the thermostatic unit for selection in the percentage of available air capacity used but to do so compatible with the other functions of the unit.

For the achievement of these and other objects, this invention proposes a control arrangement wherein the orientation of a control damper in the air delivery duct is established by an actuator the operation of which is influenced by a pressure responsive assembly. The pressure responsive assembly is part of an overall control positionable in the room being serviced and is connected to respond to the internal duct pressure which is representative of flow volume in the duct. The control also includes temperature sensing capability connected to the pressure responsive assembly and effective to establish a variable base condition (corresponding to a selected room temperature) against which the sensed duct pressure must react. In this manner, a particular temperature to be maintained in the room is selected and the diaphragm reacts to control the actuator operation establishing the proper damper setting, i.e. the necessary air flow volume, to maintain the selected temperature with a constant volume of air flow.

In a preferred embodiment the temperature sensing capability is provided by a temperature responsive member which, in response to temperature changes, produces motion against a preselected bias to establish the base condition. The combination temperature sensing mechanism and biasing means produces motion in opposite directions which is utilized, in a single thermostatic unit, to provide, in a continuous manner, switching between heating and cooling operations.

Also adjusting means is associated with the means whereby the base condition in the pressure responsive assembly is established to permit selection in the percentage of the available air capacity which is used.

Other objects and advantages will be pointed out in or be apparent from, the specification and claims, as will obvious modifications of the embodiments shown in the drawings, in which:

FIGS. 6–9 are a series of views illustrating the various settings of the control cam arrangement;

FIG. 10 is a top plan view of a portion of an alternative embodiment of the thermostatic control;

FIG. 11 is a section taken along lines 11—11 in FIG. 10 and also schematically illustrating a control for continuous switching between heating and cooling operations;

FIG. 12 is a side view of the arrangements of FIGS. 10 and 11; and

Description of Preferred Embodiments

Throughout the discussion of the preferred embodiment, the system will be described as one wherein cold air is being delivered to a room or other interior area in a building to maintain a desired temperature. It will be appreciated, however, that other applications are possible within the scope of the invention.

Figure 1:
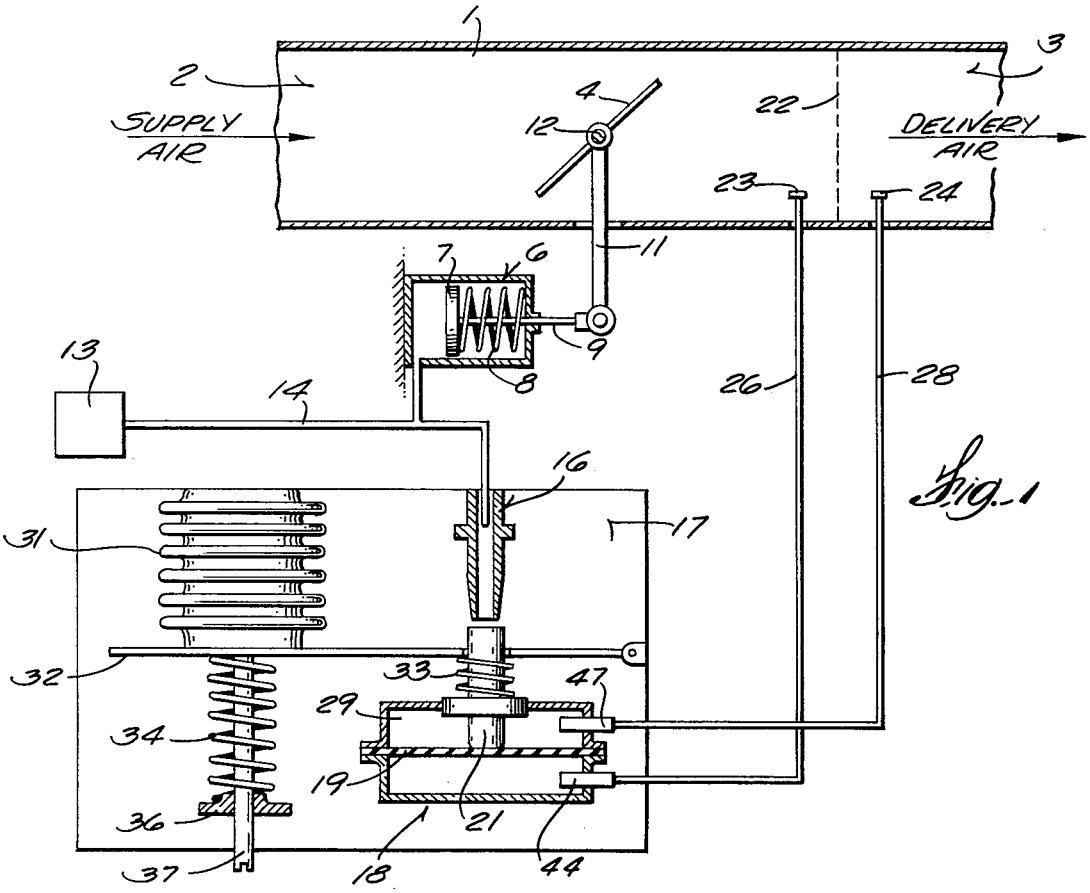
FIG. 1 is a general schematic illustration of the thermostatic control and air delivery system embodying this invention.

With particular reference to FIG. 1, an air delivery duct 1 is schematically illustrated as receiving supply air at its left end 2 which passes through the duct and is discharged as delivery air at its duct end 3, e.g. into a room being serviced. In a conventional manner, a damper 4 is pivotally mounted in duct 1 to control the volume of air flow through the duct. In conventional building air distribution systems where this invention might be used, the upstream pressure of the supply air, i.e. upstream of the delivery point, may vary during operation. The air is supplied to the duct at a preselected temperature as is conventional and well known and the setting of damper 4 is varied to pass whatever volume of air is necessary to maintain a particular desired temperature in the room or area in which the air is being discharged. It is desirable that once the temperature condition has been selected and damper 4 set accordingly, that the delivery air be discharged at a relatively constant volume so as to minimize temperature fluxuations in the room or area being serviced.

In general terms, this invention proposes to provide a control arrangement which permits selection of the desired temperature, and corresponding setting of damper 4, but which will also maintain a constant volume air discharge into the room being serviced by monitoring the flow volume and providing means which reacts to variations in flow volume to adjust the damper as required to return to the constant flow volume to be maintained. As is schematically illustrated in FIG. 1, actuator 6 in the form of a pneumatic damper actuator includes a piston 7 loaded by spring 8 and connected by linkages 9 and 11 to damper 4, in a conventional manner, to pivot damper 4 about axis 12 in response to piston movement. Pneumatic actuator 6 is connected by line 14 to a source 13 of control air. The air flow from source 13 is constant and is introduced into actuator 6 to exert pressure on piston 7 against spring 8. When air pressure on piston 7 exceeds the force of spring 8, the piston moves producing corresponding movement of linkages 9 and 11 to pivot damper 4 as required. Correspondingly, with a reduction of the air pressure on piston 7, spring 8 produces piston movement and damper movement in an opposite direction.

The setting of damper 4 is controlled by providing a bleed port 16 which communicates with line 14. When the bleed port is open, an amount of the control air from source 13 is bled off preventing build up of air pressure on piston 7 and damper 4 maintains an assumed position. Bleed port 16 is part of a control mechanism 17 (a thermostatic unit) which includes means for closing off bleed port 16, in which event air pressure can then build up on piston 7 with the above described results. This means of closing off the bleed port takes the form of a diaphragm assembly 18 including a conventional, flexible diaphragm 19 and a plug 21 fixed to and movable with the diaphragm. The plug extends toward the open end of bleed port 16. The spacing of plug 21 with respect to the end of the bleed port will determine the volume of air being bled off from line 14. In order that the spacing will correspond to the volume of flow of delivery air, diaphragm 19 is exposed to a pressure condition determined by the pressure within duct 1, which pressure is indicative of the volume of flow of delivery air. More specifically, restrictor 22 extends across duct 1 and pressure sensors 23 and 24 are positioned on the upstream and downstream sides of the restrictor. The restrictor does not substantially impede air flow through the duct but a pressure drop does occur across the restrictor which is dependent upon the volume of air flowing through end 3 of the duct. This pressure drop is monitored by sensors 23 and 24. The restrictor in effect produces an amplified pressure signal determined by the duct pressure.

Sensor 23 is on the high pressure side of the restrictor and is connected by line 26 to chamber 27 in the diaphragm assembly. Similarly, low pressure sensor 24 is connected by line 28 to chamber 29 of the diaphragm assembly. The difference in pressure between chambers 27 and 29 thus causes diaphragm 19, and correspondingly plug 21, to assume a position determined by the volume of delivery air flow. Should the volume of delivery air increase, the difference in pressure at sensors 23 and 24, and similarly between chambers 27 and 29, increases causing plug 21 to move toward bleed port 16 thereby reducing the amount of air bled from line 14. This causes air pressure on piston 7 to increase and pivot damper 4 toward a more closed position in duct 1 reducing flow volume to return to the previously set volume of flow.

To achieve a basic flow volume setting and therefore a desired temperature condition in the area being serviced, control 17 has temperature responsive capability which can be preset to provide that flow of conditioned air necessary to achieve a given temperature and will then sense any changes in temperature from the preset condition and produce a change in the air bled through bleed port 16 so that the temperature change can be compensated for. More particularly, control 17 includes a conventional, thermostatic charged bellows 31 connected to a pivotally mounted lever 32. Spring 33 is seated between lever 32 and plug 21 so that spring 33 loads diaphragm 19 and will establish a base position for the diaphragm about which the diaphragm will operate to control volume. Lever 32 is also engaged by compression spring 34, the spring being seated between lever 32 and base nut 36 threaded onto a control screw 37. Through balancing of the pressure exerted by the charge bellows 31 and the force of spring 34, the initial setting of lever 32, and therefore the force of spring 33, can be established and by conventional calibrating techniques the select temperature point can then be varied by rotating screw 37 to vary the spring force 34.

With this arrangement it can be seen that a particular temperature can be selected by setting the bellows spring arrangement. Assuming that the system has stabilized at that selected temperature, variations in flow volume, due to the variances in pressure and the supply air, will be sensed at restrictor 22 and translated into a change in the amount of air escaping through bleed port 16 to produce the requisite movement of piston 7 and the actuator to vary the setting of damper 4 to maintain a constant volume flow. As the bellows senses changes in temperature it moves to change the spring force on the diaphragm which results in the necessary damper movement to either increase or decrease air flow as may be required to return to the selected temperature.

Figure 2:
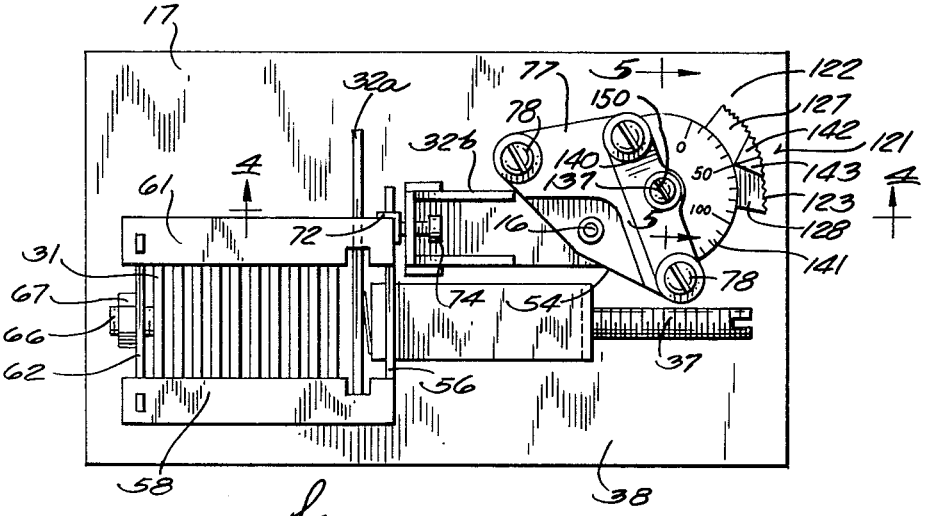
FIG. 2 is a top plan view of the thermostatic control.
Figure 3:
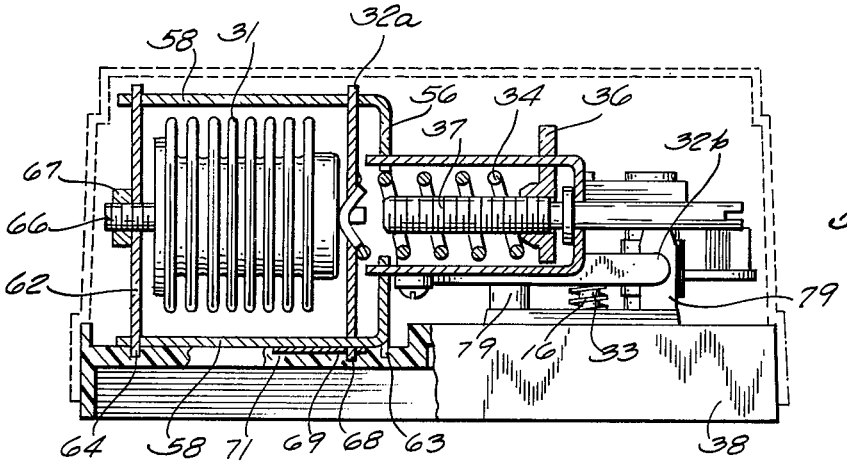
FIG. 3 is a side elevation of the control of FIG. 2.
Figure 4:
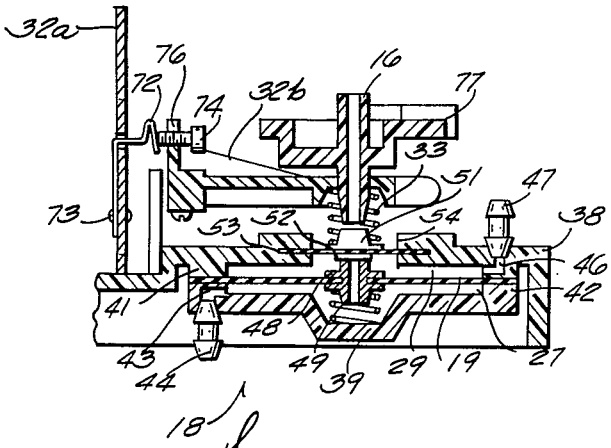
FIG. 4 is a section view taken generally along line 4—4 of FIG. 2.

Having thus described the general arrangement of elements and their operation, attention will now be directed to FIGS. 2–4 for a description of a specific structural embodiment.

Control 17 includes a base 38, made of suitable material. Diaphragm assembly 18 is formed by a part of base 38 and a cap 39 removably attached to the underside of base 38. Diaphragm 19 is clamped between annular shoulders 41 and 42 provided on base 38 and cap 39. A channel 43 is provided in cap 39 and through junction 44 connects with line 26, channel 43 opens into chamber 27. Similarly, a channel 46 is provided in base 38 and through junction 47 is connectable to line 28, channel 46 opens into chamber 29. Bleed port plug 21 is connected to diaphragm 19 by members 48 and 49 fixed to the plug and clamping a portion of the diaphragm therebetween. The plug also extends through a similar arrangement of a pair of clamping members 51 and 52 which clamp onto sealing diaphragm 53 which seals opening 54 in base 38 through which the plug extends.

The schematically illustrated lever of FIG. 1, in the specific embodiment of FIGS. 2–4 actually takes the form of two separate levers 32*a* and 32*b*. Bellows 31 is mounted within a generally U-shaped frame including a base 56 and two pairs of legs 58 and 61. The back, or open end of frame 56 is closed by a back plate 62 and the frame is seated in base 38 by means of tabs 63 and 64 projecting from the frame into complementary openings in the base. One end of bellows 31 is anchored to back plate 62 by a screw 66, which is connected to the bellows, and nut 67. The opposite or free end of bellows 31 abuts lever 32*a*. Lever 32*a* has tabs 68 seated in complementary openings in base 38 and those tabs are engaged by a leaf spring 69 connected to the underside of lower legs 58 and 61 by machine screws. Spring 34 engages lever 32*a* and provides a biasing force against which the pressure exerted by bellows 31 must react. Lever 32a is thus free to pivot about a generally horizontal pivot defined by tabs 68 depending on any unbalance in the forces exerted by diaphragm 31 and spring 34.

As is perhaps best illustrated in FIG. 4, the connection between lever 32*a* and 32*b* is made by an overload spring 72, this spring being connected to lever 32*a* by rivet 73 and engaging an adjustable screw 74 carried on a vertical wall 76 which is a part of lever 32*b*. In this manner, the initial set point determined by the balancing of the forces exerted by bellows 31 and spring 34 positions lever 32*b* and stresses spring 33 to produce the biasing force acting on diaphragm 19. Bleed port 16 is connected to a mounting plate 77, or can be molded as an integral part thereof. The mounting plate is in turn secured to base 38 through screws 78 which engage posts 79 molded on base 38. With this arrangement bleed port 16 is held in a fixed position whereas plug 21 is free to move relative to the end of the bleed port to completely close off or vary the amount of air being bled off and lever 32*b* is also free to move to vary the spring force against which the diaphragm, and correspondingly, the pressure sensed in the duct, must act.

Control 17 is positionable within the room being serviced. Screw 37 is associated in a conventional manner with a thermostat temperature scale, not shown but providing selection generally across the usual temperature range of 55° F. to 85° F. The screw is manipulated to the particular temperature setting thereby setting the force of spring 34 which balances with the force being exerted by charged bellow 31 to establish an initial position of lever 32*a*. This also establishes the position of lever 32*b* and the force of spring 33 which then determines the pressure difference necessary between chambers 29 and 27 of the diaphragm assembly to position plugs 21 such that sufficient air is being bled from line 14 to maintain a given setting of damper 4. In other words, the system will be driven until it reaches the desired temperature in the room and will then stabilize with just that amount of air being bled through port 16 to maintain actuator 17 inactive and hold the necessary set point of damper 14 to provide that volume of air necessary to maintain the desired temperature. Should any fluxuations in temperature in the room or in pressure of supply air occur, these will be sensed either by the bellows in the room, or the pressure sensor 23 and 24 in the duct 1 and fed back into the control mechanism for proper compensation.

For example, in the case of maintaining constant volume for a given temperature setting, should the pressure of the supply air increase which would thereby increase the volume of air flowing past damper 4, this will be sensed at restrictor 22 producing a greater pressure drop between sensors 23 and 24 causing the pressure in chamber 27 to increase relative to that in chamber 29. This moves plug 21 toward bleed port 16 throttling down the amount of air bled thereby allowing the pressure to build up on piston 7. This build up of pressure will drive the damper 4 toward a more closed position reducing the amount of air flowing past the damper such that the volume of air will now be returned to the desired constant value. Conversely should the pressure of the supply air drop, this will be sensed at the sensors and will be translated into motion of plug 21 away from the bleed port causing more air to bleed off reducing the air pressure on piston 7 and allowing spring 8 to move the piston and correspondingly open the damper to permit more air to flow past the damper and again return to the volume of flow to be held constant.

It has been observed that with this arrangement, a constant volume flow of air into a room being serviced can be effectively maintained for a given temperature setting.

In most buildings, as previously stated, the rooms and other areas may be heated continuously by the electric lighting and in that case cold air is delivered to the room to maintain the constant temperature. Even in such installations it may become necessary to switch to introduction of hot air should the lighting, etc. be inadequate. In a more specific aspect of this invention, the fact that the bellows 31 and spring 34 are capable of providing control motion in two opposite directions is utilized to include in the thermostatic control not only the provision for control over a heating function, i.e. the introduction of cold air to the excessively heated area to maintain a constant temperature, but also is utilized to switch to and control a heating function.

More particularly, as has already been described, lever 32a will move either to the left or the right as viewed in FIG. 2 depending upon the expansion or contraction of the charge in bellows 31. A control arrangement 81 is associated with the end of lever 32*a* which extends beyond frame 56. This is illustrated in FIGS. 10, 11, and 12 wherein only the additional elements added by this variation are shown with only so much of the already described mechanism as is necessary to understand this variation. With reference to FIG. 10, a reheat lever 82 includes a body portion 83 and leg portions 84 and 86 projecting laterally from opposite sides of the body. The lower end of body 83 terminates in pointed tabs 87 and 88 which rest in V-shaped grooves 89 and 91. With this construction, reheat lever 82 is supported for rocking movement in the V-shaped grooves. Legs 84 and 86 overlie ports 93 and 94 in base 38. A leaf spring 96 extends from post 97 on base 38 and engages the upper side of leg 86 to bias the reheat lever in such a manner that leg 86 is normally engaged on port 94, i.e. port 94 is normally closed and port 93 is normally open. The connection between lever 32a and the reheat lever is accomplished by screw 98 which engages spring 99 connected to the main body 83 of the reheat lever.

In operation, control 81 is associated with a pneumatic actuator 101 which is connected to a switch actuating arm 102 through linkages 103 and 104. Linkage 104 is connected to actuator piston 106 which is biased by spring 107. A control source of air 108 is connected to the interior chamber of actuator 101 by lines 109 and 111. Port 94 can be a dummy port or used to control some other function. Port 93 is connected by line 112 to the control source of air and when the control 81 is in its normal position, port 93 bleeds air off from lines 109 and 111 so that actuator 101 is inactive and lever 102 engages switch 113 calling for a cooling operation as has already been described. In the event that the temperature in the room being serviced drops to a point where the contraction of bellows 31 is such that lever **32*a* drives the reheat lever to close port 93 (indicating a heating cycle is necessary), the pressure build up on piston 106 will switch actuator 102 to close heat switch 114 and open cool switch 113 initiating a heating operation and terminating the cooling operation. That is, rather than cool air being transported through ducts 1,** hot air will now be transported through the duct and the volume of air flow will be controlled in the same manner previously described in connection with the cooling cycle. This provides in the same unit continuous switching between and control of heating and cooling cycles.

Figure 13:
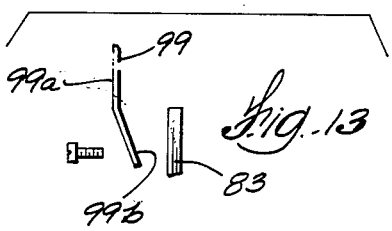
FIG. 13 is an exploded view of the prestressed overload spring.

It is recognized that in some cases the contraction of the bellows may be such that the full force of spring 34 might be transmitted to reheat lever 82 thereby exposing the reheat lever and/or the port seats to damage. To accommodate this possible excessive force, spring 99 is in the connection between levers **32*b* and 82 and is prestressed. As illustrated in FIG. 13, the spring in its free position has two angularly related portions 99*a* and 99*b* and the spring is flattened when it is connected to the reheat lever. Flattening of the spring produces an inherent biasing force which is selected such that it is sufficient to overcome the normally encountered forces acting on lever 32*a*. However, when excessive forces are encountered, the lever through screw 98 will displace the free end of spring 99, the spring 99** then acting as overtravel spring accommodating the entire motion without transmitting excessive forces to either the reheat lever or the port.

The switchover point between heating and cooling operation can be accurately adjusted by manipulating screw 98 and thus a continuous switching from either heating to cooling or vice versa is accomplished in a single thermostatic unit with a minimum of possible overlap in function.

In addition to the various adjustments and settings provided for in the mechanism already described, an additional adjusting mechanism 121 is provided to permit selection of a desired percentage of the available air capacity. The adjustment is such as to permit selection from 0 to 100% of available capacity.

Figure 5:
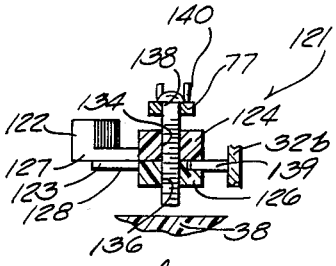
FIG. 5 is a section view taken generally along line 5—5 of FIG. 2.

More particularly, two cam members 122 and 123 are each made up of a cylindrical body 124 and 126 and radially extending wings 127 and 128. The construction of cam members 122 and 123 perhaps can be best appreciated from viewing FIGS. 2 and 5. Each body includes peripheral, generally arcuate groove 129 and 131 which are complementary and have surfaces 132 and 133 that are mutually parallel, when connected, and are curvilinear relative to a radial plane.

In the assembly cam members are mounted by a screw 137 which is threaded through central openings 134 and 136. The screw holds the cam members together with grooves 129 and 131 facing each other defining a peripheral arcuate notch while permitting them to be moved relative to each other. Screw 137 extends through a clearance opening 138 in mounting plate 77 and when so positioned the cam members are at the end of lever 32b which includes a pin projection 139 fitting into the notch defined by the grooves. Spring 140 is attached to plate 77 and extends over screw 137 exerting sufficient pressure between the screw and plate to hold the screw against rotation unless it is turned through its slot 150. With this arrangement the cam members can be rotated together and will move pin 139 up and down and correspondingly lever **32*b*. Also, turning the screw will move the cams and pin vertically. This will vary the biasing force of spring 33** and in so doing it will result in positioning the damper to provide a particular percentage of available air capacity.

As seen in FIG. 2, the cam members are associated with plate 141 which carries indicia from 0 to 100%, representative of percentage of air capacity. The cam members include vertical wedges 142 and 143 which together, and when separated, define pointers. Rotating the cam members together can vary the spring bias to select a given percentage of available capacity. In FIG. 2 they are set to 50%, and this corresponds to FIG. 7, at 0% (FIG. 8) no air is delivered, at 100% (FIG. 9) all available capacity is used. Other settings are also possible. This sets a definite percent of capacity which is used in achieving the already described operation. The volume of air used is thus variable but once selected a constant volume is maintained at that value. This adds versatility to the overall system operation.

The adjusting mechanism 121 can also provide for variable delivery volume between a wide range of available maximum and minimum settings. This is achieved by rotating the cam members relative to each other with cam 127 setting the minimum and 128 the maximum. For example, pointer 142 can be set to 20% and pointer 143 to 80%. Grooves 129 and 131 are now out of alignment so that pin 139 is not held in the notch but is free for limited movement as the cam surfaces are spaced apart a distance greater than the diameter of the pin. Now the control can vary the capacity of available air from 20% to 80%, but will maintain constant volume delivery at the particular capacity being used. Thus even greater versatility is provided for.

Initial adjustment of lever **32*b* can be made by turning screw 137** and friction between the cams and screw holds the cams in any selected position.

Although this invention has been illustrated and described in connection with particular embodiments thereof, it will be apparent to those skilled in the art that various changes and modifications may be made therein without departing from the spirit of the invention or from the scope of the appended claims.

We claim:

1. In an air delivery system including duct means for delivering air to an area being serviced, means for supplying air to said duct means, damper means in said duct means and mounted to assume any one of a number of available positions in said duct means for controlling the volume of air flowing therethrough, actuator means connected to and operative to move said damper means selectively to one of said positions; the improvement of temperature and pressure responsive control means positioned in the area being serviced and comprising, in combination, pressure responsive means connected to and controlling the operation of said actuator means, means connecting said pressure responsive means for exposure thereof to the interior of said duct means so that said pressure responsive means controls said actuator means in accordance with the pressure condition in said duct means, said pressure responsive means including biasing means producing a bias force reacting against the pressure condition to which said pressure responsive means is exposed, and temperature responsive means engaging said biasing means and influencing the magnitude of said bias force and operative to establish bias forces in accordance with the temperature ambient said temperature responsive means so that the position of said damper means in said duct means is determined by the reaction between said biasing means and the pressure condition in said duct means and said pressure responsive means controls said actuator means and in turn said damper means to maintain the volume of flow through said duct substantially constant.

2. The combination of claim 1 wherein said temperature responsive means is adjustable to select a particular ambient temperature.

3. The combination of claim 1 wherein said pressure responsive means comprises a diaphragm and said biasing means produces said bias force on said diaphragm, and including means in said duct means for sensing the pressure in said duct means and transmitting said sensed pressure to said diaphragm.

4. The combination of claim 1 wherein said control means includes a base, said pressure responsive means includes means defining two chambers in said base and a diaphragm separating said chambers, means in said duct means for sensing duct pressure and connected to said chambers to produce a pressure differential across said diaphragm, and wherein said biasing means is connected to said diaphragm.

5. The combination of claim 4 wherein said actuator is pneumatically operated, a source of air is connected to and is operative to energize said actuator, a bleed port is included in the connection of said air source to said actuator through which air can be bled to control actuator operation, plug means positioned at said bleed port and connected to and movable with said diaphragm relative to said bleed port to vary the amount of air being bled through said port.

6. In an air delivery system including duct means for delivering air to an area being serviced, means for supplying air to said duct means, damper means in said duct means and mounted to assume any one of a number of available positions in said duct means for controlling the volume of air flowing therethrough, actuator means connected to and operative to move said damper means selectively to one of said positions; the improvement of temperature and pressure responsive control means positioned in the area being serviced and comprising, in combination, a base, pressure responsive means connected to and controlling the operation of said actuator means, said pressure responsive means including means defining two chambers in said base and a diaphragm separating said chambers, means in said duct means for sensing duct pressure and connected to said chambers to produce a pressure differential across said diaphragm so that said pressure responsive means is exposed to the interior of said duct means and said pressure responsive means controls said actuator means in accordance with the pressure condition in said duct means, said pressure responsive means also including biasing means connected to said diaphragm and producing a bias force reacting against the pressure condition to which said pressure responsive means is exposed, temperature responsive means comprising a charged bellows, means connecting said bellows to said base, and lever means connecting said bellows to said biasing means so that the bias force generated by said biasing means is varied in accordance with the expansion and contraction of said bellows and in accordance with the temperature ambient said bellows whereby said temperature responsive means is connected to said biasing means and influences the magnitude of said bias force and is operative to establish bias forces in accordance with the temperature ambient said temperature responsive means so that the position of said damper means in said duct means is determined by the reaction between said biasing means and the pressure condition in said duct means and said pressure responsive means controls said actuator means and in turn said damper means to maintain the volume of flow through said duct substantially constant.

7. The combination of claim 6 wherein said actuator is pneumatically operated, a source of air is connected to and is operative to energize said actuator, a bleed port is included in the connection of said air source to said actuator through which air can be bled to control actuator operation, plug means positioned at said bleed port and connected to and movable with said diaphragm relative to said bleed port to vary the amount of air being bled through said port.

8. In an air delivery system including duct means for delivering air to an area being serviced, means for supplying air to said duct means, damper means in said duct means and mounted to assume any one of a number of available positions in said duct means for controlling the volume of air flowing therethrough, actuator means connected to and operative to move said damper means selectively to one of said positions; the improvement of temperature and pressure responsive control means positioned in the area being serviced and comprising, in combination, pressure responsive means connected to and controlling the operation of said actuator means, means connecting said pressure responsive means for exposure thereof to the interior of said duct means so that said pressure responsive means controls said actuator means in accordance with the pressure condition in said duct means, said pressure responsive means including biasing means producing a bias force reacting against the pressure condition to which said pressure responsive means is exposed, temperature responsive means, lever means connecting said temperature responsive means to said biasing means, said temperature responsive means producing motion of said lever in one direction in response to an increase in temperature ambient said temperature responsive means and an opposite direction in response to a decrease in said ambient temperature, whereby said temperature responsive means is connected to said biasing means and influences the magnitude of said bias force and is operative to establish bias forces in accordance with the temperature ambient said temperature responsive means so that the position of said damper means in said duct means is determined by the reaction between said biasing means and the pressure condition in said duct means and said pressure responsive means controls said actuator means and in turn said damper means to maintain the volume of flow through said duct substantially constant, and reheat means adjacent to and engageable by said lever means, said reheat means connected to and operative to actuate means for switching said air delivery system from a heating cycle to a cooling cycle;

said reheat means having a normal position establishing one of said cycles and being moved from said normal position by said lever means to establish the other cycle.

9. The combination of claim 8 wherein said pressure responsive means includes a diaphragm, including means in said duct means for sensing duct pressure and connected to said diaphragm to produce a pressure differential across said diaphragm, wherein said biasing means is connected to said diaphragm, wherein said temperature responsive means comprises a charged bellows, and wherein said lever means connects said bellows to said biasing means so that the bias force generated by said biasing means is varied in accordance with the expansion and contraction of said bellows in accordance with the temperature ambient said bellows.

10. The combination of claim 9 including means for adjusting the bias force produced by said biasing means acting against said bellows.

11. The combination of claim 9 wherein said lever means includes first and second levers, wherein said bellows engages said first lever, including biasing means engaging said first lever and producing a bias force against which said bellows expands, said first lever being moved in one direction by bellows expansion and in an opposite direction by said biasing means as said bellows contracts, said first lever being engageable with said reheat means, and wherein said second lever connects said first lever to said biasing means producing the bias force on said diaphragm.

12. In an air delivery system including duct means for delivering air to an area being serviced, means for supplying air to said duct means, damper means in said duct means and mounted to assume any one of a number of available positions in said duct means for controlling the volume of air flowing therethrough, actuator means connected to and operative to move said damper means selectively to one of said positions; the improvement of temperature and pressure responsive control means positioned in the area being serviced and comprising, in combination, pressure responsive means connected to and controlling the operation of said actuator means, means connecting said pressure responsive means for exposure thereof to the interior of said duct means so that said pressure responsive means controls said actuator means in accordance with the pressure condition in said duct means, said pressure responsive means including biasing means producing a bias force reacting against the pressure condition to which said pressure responsive means is exposed, temperature responsive means, lever means connecting said temperature responsive means to said biasing means and through which said temperature responsive means operates on said biasing means to influence the magnitude of said bias force and is operative to establish bias forces in accordance with the temperature ambient said temperature responsive means so that the position of said damper means in said duct means is determined by the reaction between said biasing means and the pressure condition in said duct means and said pressure responsive means controls said actuator means and in turn said damper means to maintain the volume of flow through said duct substantially constant, first and second cam members each including a groove disposed at an oblique angle to the axis along which said biasing means acts, said grooves being complementary and when registered defining a notch at said oblique angle, a projection on said lever means extending into said notch, and means mounting said first and second cam members for joint and relative movement to establish a preselected position of said lever means.

13. The combination of claim 12 wherein said cam members are generally cylindrical and said grooves are provided in the periphery of said cam members and said grooves are at an oblique angle to a radial plane perpendicular to the axis of said cam members, including a scale mounted adjacent said cam members and calibrated in percentage of available air delivery capacity, and pointers on each of said cam members associated with said scale.

14. The combination of claim 13 wherein said pressure responsive means comprises a diaphragm and said biasing means produces said bias force on said diaphragm, and including means in said duct means for sensing the pressure in said duct means and transmitting said sensed pressure to said diaphragm.

15. The combination of claim 14 wherein said actuator is pneumatically operated, a source of air is connected to and is operative to energize said actuator, a bleed port is included in the connection of said air source to said actuator through which air can be bled to control actuator operation, plug means positioned at said bleed port and connected to and movable with said diaphragm relative to said bleed port to vary the amount of air being bled through said port.

16. The combination of claim 15 wherein said control means includes a base, said pressure responsive means includes means defining two chambers in said base and a diaphragm separating said chambers, means in said duct means for sensing duct pressure and connected to said chambers to produce a pressure differential across said diaphragm, and said biasing means is connected to said diaphragm.

* * * * *